US007748806B2

(12) United States Patent
Egan

(10) Patent No.: US 7,748,806 B2
(45) Date of Patent: Jul. 6, 2010

(54) ENCAPSULATED SLIDING SHELF AND OVER-MOLDED FRAME

(75) Inventor: Martin Shawn Egan, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 811 days.

(21) Appl. No.: 11/214,353

(22) Filed: Aug. 29, 2005

(65) Prior Publication Data

US 2007/0046160 A1 Mar. 1, 2007

(51) Int. Cl.
*A47B 96/04* (2006.01)

(52) U.S. Cl. ..... 312/408; 108/108; 108/102; 312/223.6

(58) Field of Classification Search ..... 312/408, 312/404, 351; 108/106, 107, 108; 700/9, 700/17, 60, 83; 174/45 R
See application file for complete search history.

(56) References Cited

U.S. PATENT DOCUMENTS 1,302,882 A * 5/1919 Terrell ..... 108/109
3,080,149 A * 3/1963 Pilboue ..... 256/57
3,102,641 A * 9/1963 Konstant et al. ..... 211/191
3,220,679 A * 11/1965 Larson ..... 248/71
3,422,775 A * 1/1969 Johnsson ..... 108/109
3,562,403 A * 2/1971 Monahan et al. ..... 174/45 R
3,580,439 A * 5/1971 Jewett et al. ..... 224/328
3,618,365 A * 11/1971 McArthur ..... 73/45.1
4,142,638 A * 3/1979 Vargo ..... 211/187
4,607,576 A * 8/1986 Kranjec ..... 108/110
4,996,929 A * 3/1991 Saal ..... 108/107
5,441,338 A 8/1995 Kane et al. ..... 312/408
5,464,575 A 11/1995 Jaffiol et al. ..... 264/443
5,564,809 A * 10/1996 Kane et al. ..... 312/408
5,626,084 A * 5/1997 Kelly et al. ..... 108/23
5,641,217 A 6/1997 Caruso et al. ..... 312/404
5,735,589 A * 4/1998 Herrmann et al. ..... 312/408
5,738,880 A 4/1998 Kane et al. ..... 425/116
5,796,034 A * 8/1998 Pate ..... 174/45 R
5,913,584 A 6/1999 Swindell et al. ..... 312/408
5,934,098 A * 8/1999 Lee ..... 62/440
6,042,244 A * 3/2000 Witkoski ..... 362/133
6,123,209 A * 9/2000 Tseng ..... 211/186
6,179,434 B1 1/2001 Saraiji ..... 362/125
6,558,017 B1 5/2003 Saraiji et al. ..... 362/125
6,813,896 B1 * 11/2004 Janke et al. ..... 62/126
2003/0151340 A1 * 8/2003 Mathur et al. ..... 312/408
2004/0150305 A1 * 8/2004 Bienick et al. ..... 312/408
2006/0049729 A1 * 3/2006 Mussche ..... 312/319.6

* cited by examiner

*Primary Examiner*—Janet M Wilkens
*Assistant Examiner*—Matthew W Ing
(74) *Attorney, Agent, or Firm*—Kirk W. Goodwin; Greer, Burns & Crain Ltd

(57) ABSTRACT

A shelf arrangement is provided which includes a support surface, a frame, and an electrical control interface positioned and accessible at a front of the shelf arrangement, the control interface arranged to transmit a control signal to a location remote from the shelf arrangement. The frame may include a pair of laterally spaced apart front-to-rear brackets supporting the support surface. The support surface may be a part of a shelf member. A pair of rods may extend laterally between the brackets. The frame may be at least partially overmolded with plastic.

19 Claims, 11 Drawing Sheets

ENCAPSULATED SLIDING SHELF AND OVER-MOLDED FRAME

BACKGROUND OF THE INVENTION

The present invention relates to shelves, such as shelves for use in an appliance.

Shelves, including shelves for use in appliances, such as refrigeration appliances, are well known. In a refrigeration appliance, shelves are known which can be moved between adjustable positions, such as by utilzing shelf supporting brackets which can be removably attached to shelf ladders. Examples of these constructions are disclosed in U.S. Pat. Nos. 5,273,354, 5,362,145, 5,403,084, 5,429,433 5,441,338, 5,641,217, and 5,735,589. Some of these patents also disclose shelves having support surfaces that are slidable relative to the shelf frame. Those that have frames with cross members extending between the supporting brackets require that there be a direct mechanical connection, such as welding between the cross members and the supporting brackets, thus requiring assembly time, tools and materials for such connections.

U.S. Pat. No. 5,738,880 and some of the previous patents disclose a shelf where the support surface of the shelf is encapsulated in a plastic material. U.S. Pat. No. 5,913,584 discloses a mechanical control knob located at a front side of a refrigerator shelf for use in mechanically adjusting the vertical position of the shelf by operation of a gear mechanism. U.S. Pat. Nos. 6,179,434 and 6,558,017 disclose refrigeration appliances having lighting fixtures carried on a front edge of shelves to provide varying light distribution to vertically separated zones within the appliance.

In U.S. Pat. No. 4,638,644, a movable shelf is used to seal off an isolated portion of a refrigerator or freezer compartment to permit a modification of the temperature in that portion.

In refrigeration appliances, different zones may be provided with arrangements to allow for different cooling temperatures to be achieved and maintained in the different zones. In some instances, zones created with drawers, sometimes referred to as crisper drawers, achieve different cooling or humidity results through the use of manually adjustable slides.

In U.S. Pat. No. 6,813,896, an arrangement is provided for providing a user interface on a shelf to control a microenvironment within the refrigerator, partially bounded by the shelf. No provisions are made for routing or securing the electrical conductors leading from the user interface to the rear of the shelf.

SUMMARY OF THE INVENTION

The present invention provides a shelf arrangement having a shelf member including a support surface and a frame supporting the shelf member with an electrical control interface positioned and accessible at a front of the shelf arrangement, the control interface arranged to transmit a control signal to a location remote from the shelf arrangement.

In an embodiment, the frame comprises a pair of laterally spaced apart front-to-rear brackets and a pair of rods extending laterally between said brackets.

In an embodiment, the frame comprises a pair of laterally spaced apart front-to-rear brackets and at least one of the brackets includes a recessed channel to receive an electrical conductor extending from the control interface.

In an embodiment, the frame is at least partially encapsulated and overmolded with plastic.

In an embodiment, the frame includes seal elements extending outwardly along at least portions of a rear and two sides of the frame, and may also extend outwardly along a front of the frame.

In an embodiment of the invention, the shelf arrangement is located within an interior space of an appliance cabinet.

DETAILED DESCRIPTION OF THE PREFERRED EMBODIMENT

The present invention relates to a shelf arrangement which can be used in a wide variety of applications. In an embodiment, the shelf arrangement could be used in an environment where a remote electrical component is to be controlled by a user having ready access to a front of the shelf arrangement. In an embodiment, the shelf arrangement could be used in a controlled environment, such as a temperature controlled, humidity controlled or light level controlled environment. Other types of controlled environments are contemplated as well. In order to provide a description of an embodiment of the invention, the shelf arrangement is discussed in terms of being used in a refrigeration appliance, although the invention should not be deemed to be limited to use in such an embodiment. Other uses and embodiments, such as on other types of appliances, cabinets and locations having shelving units may be appropriate uses for the present invention.

Figure 1:
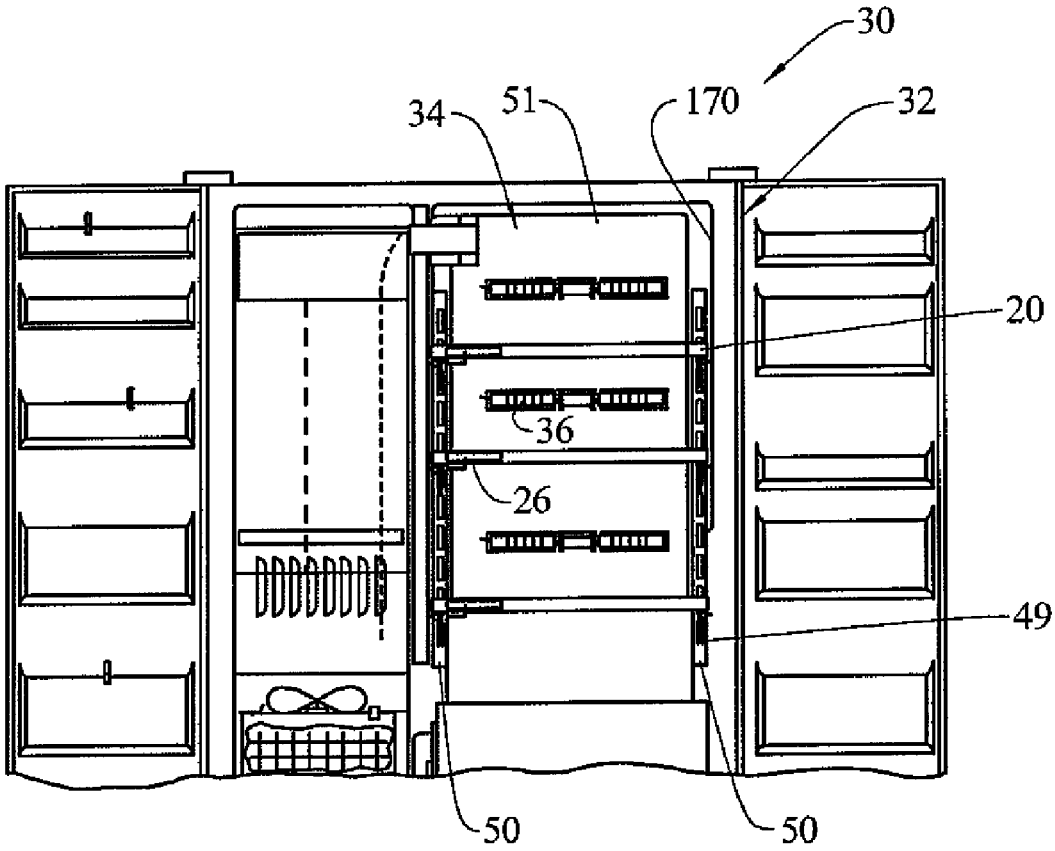
FIG. 1 is a front elevational view of a refrigeration device including a shelf arrangement embodying the principles of the present invention.
Figure 2:
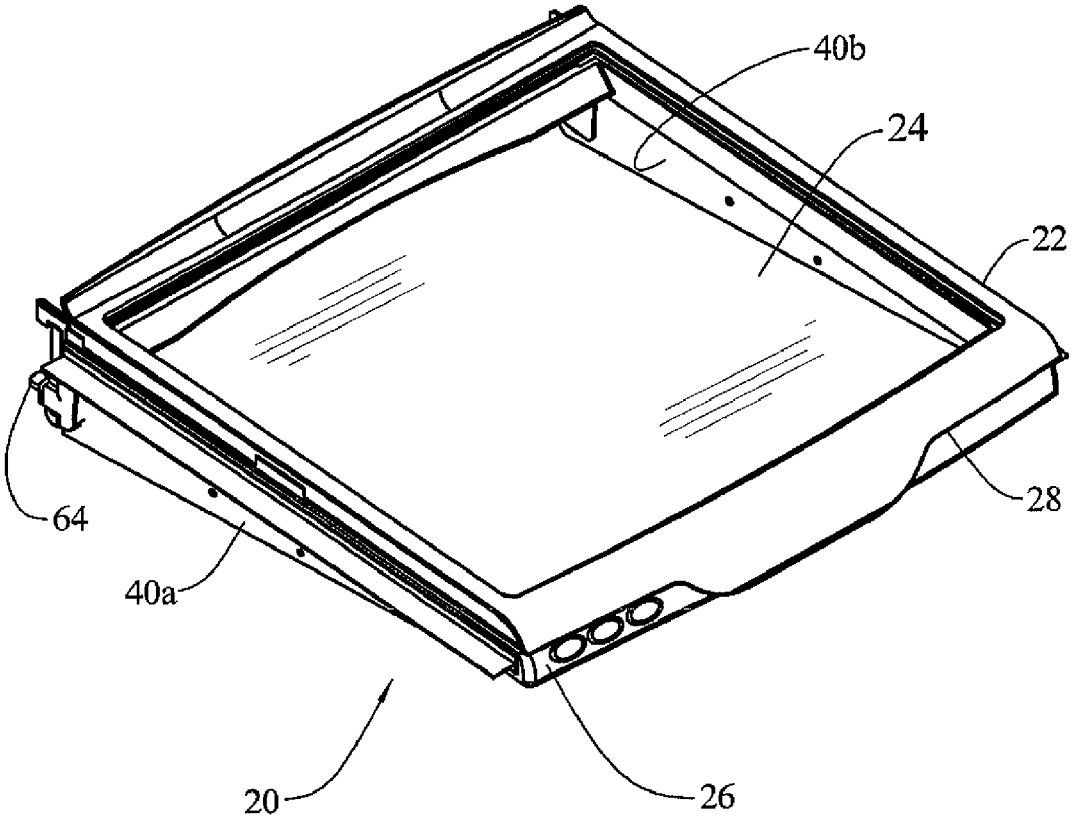
FIG. 2 is a top perspective view of the shelf arrangement embodying the present invention.

As illustrated in FIGS. 1 and 2, in an embodiment, the present invention provides a shelf arrangement 20 having a shelf member 22 including a support surface 24 and an electrical control interface 26 positioned and accessible at a front 28 of the shelf arrangement. The control interface 26 may be configured to transmit a control signal to a location remote from the shelf arrangement.

In the embodiment illustrated, there is shown a refrigeration appliance 30 having a cabinet 32 with an interior space 34. The shelf arrangement 20 is positioned within the interior space 34 and an electrical component 36 is located remote from the shelf arrangement.

Figure 3:
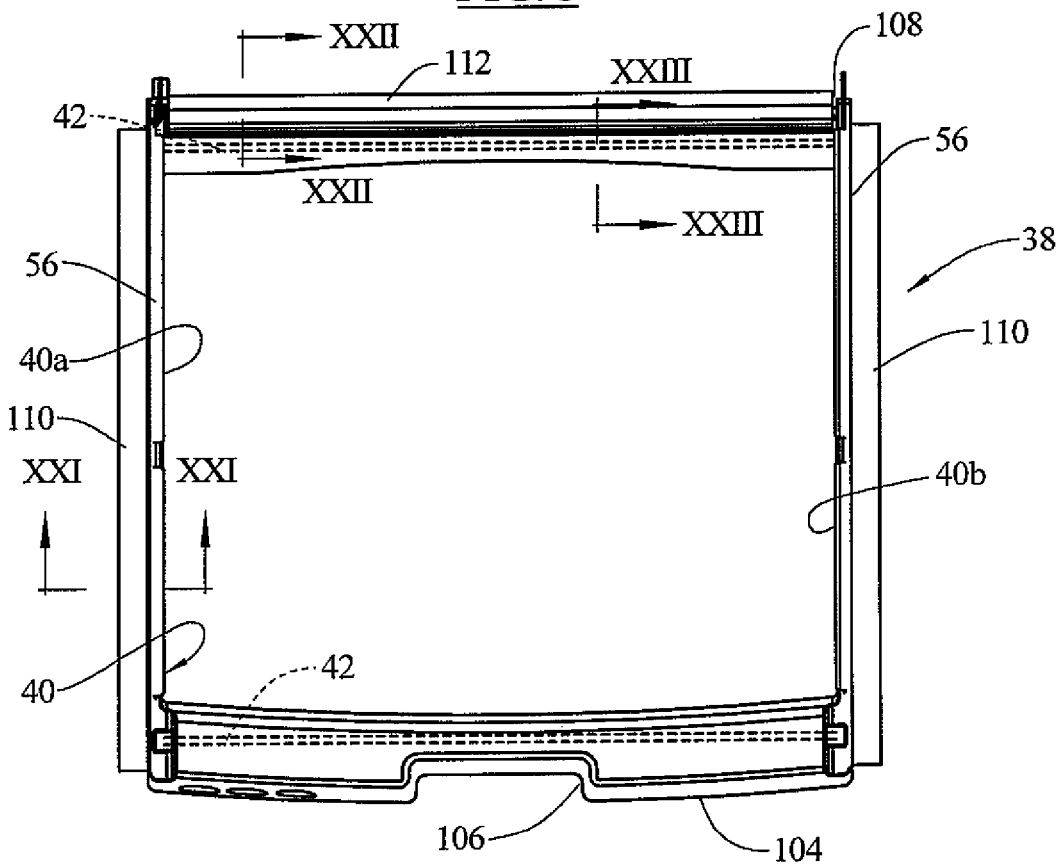
FIG. 3 is a plan view of the frame with the shelf member removed.

As seen in FIG. 3, the shelf arrangement 20 includes a frame 38 which comprises a pair of laterally spaced apart front-to-rear brackets 40 and a pair of rods 42 extending laterally between the brackets. Although the rods 42 are shown as having a circular cross section, other configurations, including square and rectangular cross sections may be used, and the rods may be configured as thin flat strips, or having other shapes. In an embodiment where the shelf member 22 is not slidable relative to the frame 38, the rods 42 are not required. A left bracket 40*a* (FIG. 4) includes an upper tab 44 and a right bracket 40*b* includes an upper 44 and a lower 46 tab projecting from a rear end 47 of a main body 48 of each bracket. The tabs 44, 46 are configured to be received in slots 49 formed in a well known shelf ladder construction 50 (FIG. 1) provided at a interior rear wall 51 in the refrigeration appliance 30. The upper tab 44 is provided with a hook portion 52 designed to catch an edge of the ladder slot 49 to prevent an unwanted disengagement of the bracket 40 from the ladder 50, as is known.

The body 48 of the right bracket 40*b* (FIG. 5) extends forwardly to a front end 54 and generally comprises a flat plate-like member oriented in an upright orientation. A portion of a top edge 56 of the body 48 is turned inwardly (FIG. 6) to form a narrow support surface, described below, in embodiments where the shelf member 22 is slidable relative to the frame 38. A horizontal rib 58 may be formed in the body 48 to increase a strength of the bracket 40*b* without requiring the body to be made of thicker material, thereby effecting a material and cost savings.

Figure 7:
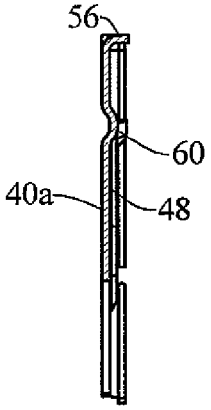
FIG. 7 is a sectional view of the left bracket taken generally along line VII-VII of FIG. 4.
Figure 8:
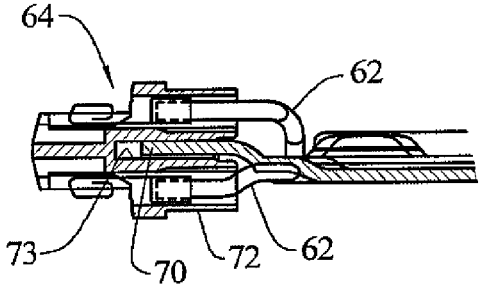
FIG. 8 is a top sectional view of the left bracket, after partial assembly with the electrical connector, and taken generally along line VIII-VIII of FIG. 4.
Figure 9:
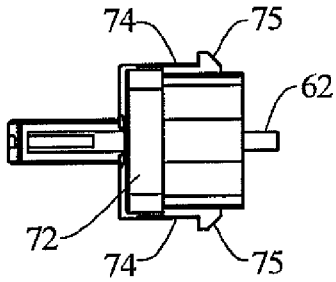
FIG. 9 is a top elevational view of the electrical connector of FIG. 8, shown in isolation.
Figure 11:
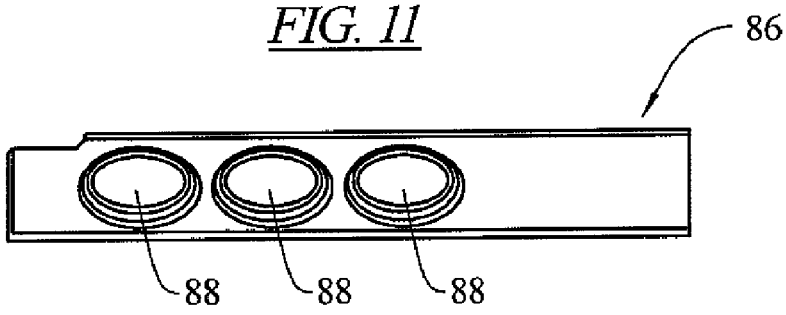
FIG. 11 is a front elevational view of the electronics pod in isolation.
Figure 12:
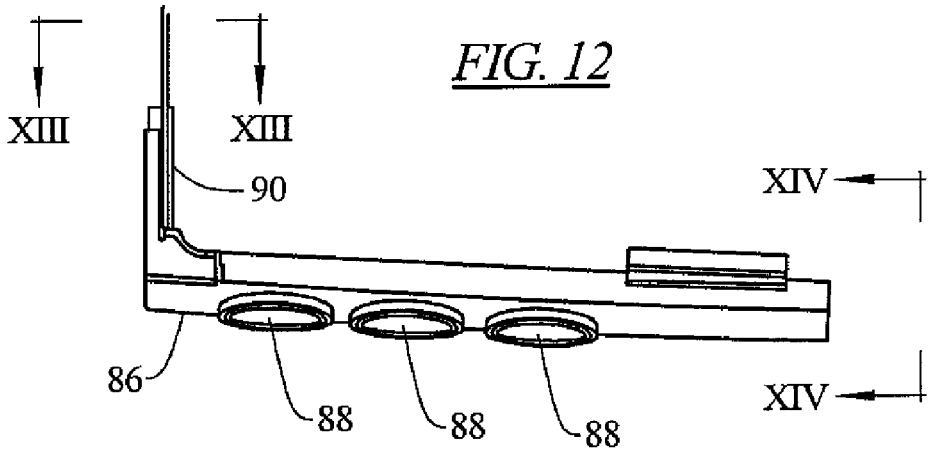
FIG. 12 is a top elevational view of the electronics pod of FIG. 11 in isolation.
Figure 13:
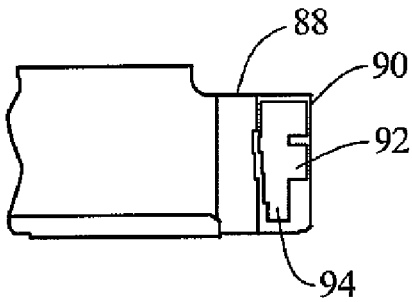
FIG. 13 is a partial rear elevational view of the electronics pod taken generally along the line XIII-XIII of FIG. 12.
Figure 14:
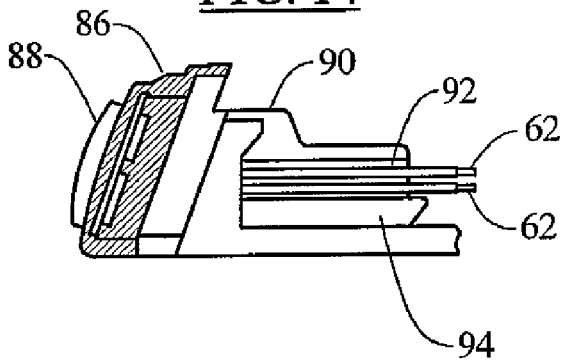
FIG. 14 is a right side elevational view of the electronics pod of FIG. 11 taken generally along the line XIV-XIV of FIG. 12.

The body 48 of the left bracket 40*a* extends forwardly to a front end 54 and generally comprises a flat plate-like member oriented in an upright orientation. A portion of a top edge 56 of the body 48 is turned inwardly (FIG. 7) to form a narrow support surface, described below. A horizontal channel 60 may be formed in the body 48 which doubles as a strengthening rib as well as a path for electrical conductors, such as wires 62, to extend from the control interface 26 at the front 28 of the shelf arrangement 20 to an electrical connector 64 attached to the rear of the left bracket 40*a*. At the rear of the left bracket 40*a*, in lieu of a lower tab, as is present in the right bracket 40*b*, a pair of recesses 66, 68 (FIG. 4) are formed in the body 48 leaving a rearwardly pointing finger 70 therebetween. The finger 70 and recesses 66, 68 are configured so as to cooperate with a body 72 (FIG. 8) of the connector 64. The connector body 72 includes a slot 73 into which the finger 70 is received, and further includes resilient arms 74 with detents 75 (FIG. 9) that are received in the recesses 66, 68 in a releasably locking manner.

Figure 4:
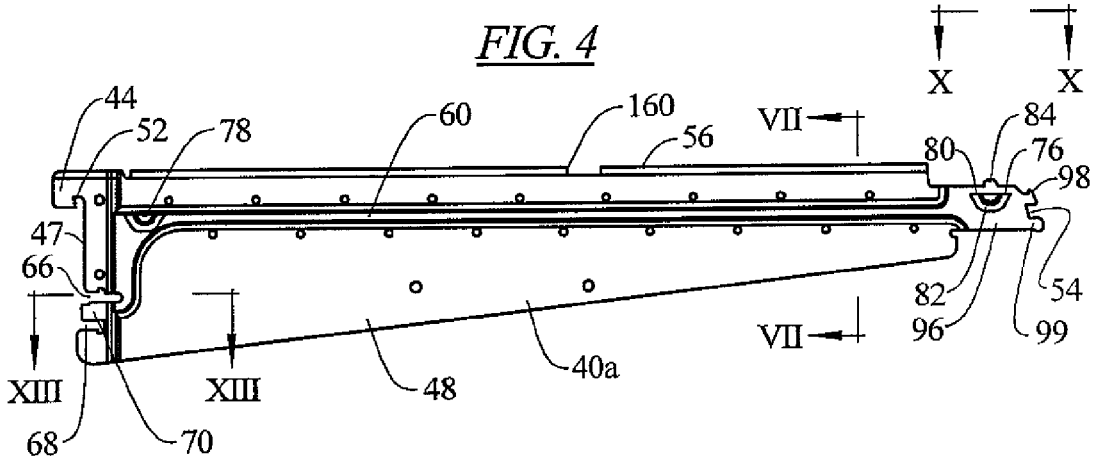
FIG. 4 is a left side elevational view of the left side bracket in isolation, and before assembly into the frame.

As shown in FIG. 4, the channel 60 is arranged such that it terminates in the area of one of the recesses 66, 68, and thus provides a continuous communication path for the wires 62 to the connector body 72. The channel 60 extends forwardly to terminate at the front end 54 of the left bracket 40*b*.

Figure 5:
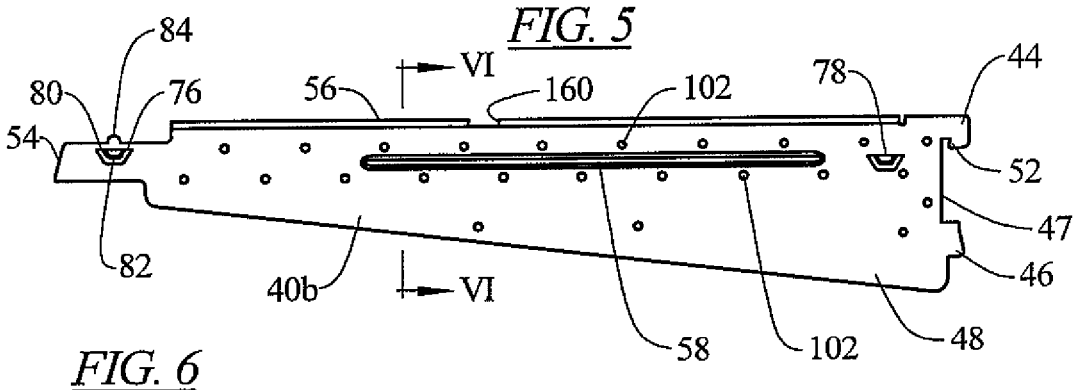
FIG. 5 is a right side elevational view of the right side bracket in isolation, and before assembly into the frame.
Figure 6:
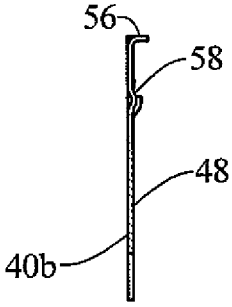
FIG. 6 is a sectional view of the right bracket taken generally along line VI-VI of FIG. 5.
Figure 10:
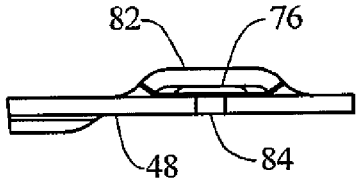
FIG. 10 is a partial top elevational view of a front end of the left bracket, and taken generally along the line X-X of FIG. 4.

As shown in FIG. 3, the rods 42 extend laterally between the right and left brackets 40, but in embodiments discussed below utilizing overmolding, they need not be directly mechanically attached to the brackets, such as by welding, screws, pins or other separate fasteners, or by mechanical interference engagement between the rods and the brackets, such as slots and tabs, threading, etc. Instead, as shown in FIGS. 4 and 5, each bracket 40 may be provided with a front 76 and a rear 78 ledge upon which one end of a lower surface area 42*a* of each rod 42 rests. The ledges 76, 78 may be formed by creating a slit 80 in the body 48 of the bracket 40 and deforming a portion 82 of the body below the slit outwardly (FIG. 10), such that a lower edge of the slit forms the ledge. The slits 80 may be linear as shown, or may have a curved or other shape configured to hold the rods 42 in place. At the front end 54 of the brackets 40, the vertical height of the bracket body 48 is reduced, and a tab 84 (FIGS. 4 and 5) projects upwardly to form a stop, against which an end of the rod 42 will abut. Thus, the rods 42 define a minimum separation distance between the two brackets 40. As described below, the rods 42 may be held in place, and the brackets 40 prevented from moving laterally apart from one another, by a plastic overmolding of the frame 38. If plastic overmolding is not utilized, then a direct mechanical fastening (of one of the described types) of the rods 42 to the brackets 40 will be required, when rods are utilized in the frame 38.

FIGS. 11-14 illustrate a user interface pod 86, containing the electrical control interface 26 and manually engagable control devices such as switches or buttons 88, which is preassembled and may be attached to the left bracket 40*a*. The pod 86 includes an arm 90 with a channel 92 for receiving and guiding the wires 62 which extend from the pod to the electrical connector 64. The arm 90 also includes a channel 94 for receiving a forwardly extending portion 96 (FIG. 4) of the left bracket 40*a*. The forwardly extending portion 96 includes upwardly 98 and downwardly 99 extending detents which snap into the channel 94 to securely lock the pod 86 onto the left bracket 40*a*. This arrangement will correctly position the wires 62 in the channel 60 and will allow the connector 64 to be inserted onto and held by the finger 70.

Figure 15:
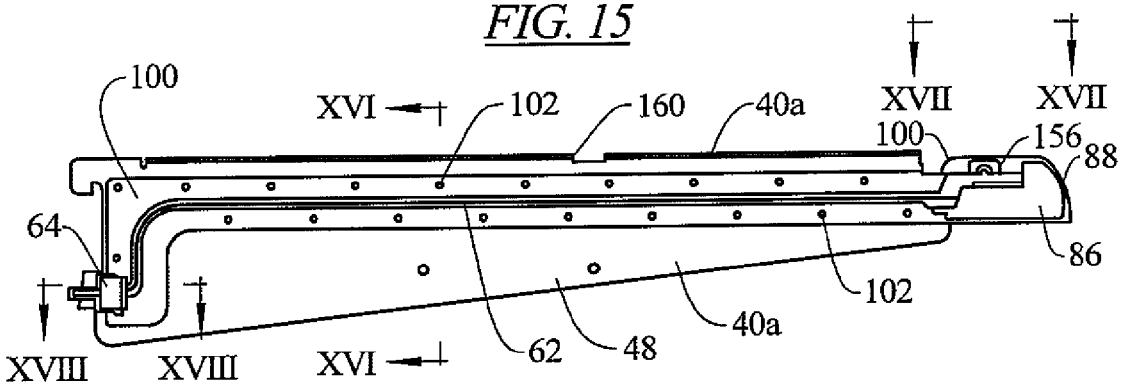
FIG. 15 is a left side elevational view of the frame after assembly and a plastic molding operation.
Figure 16:
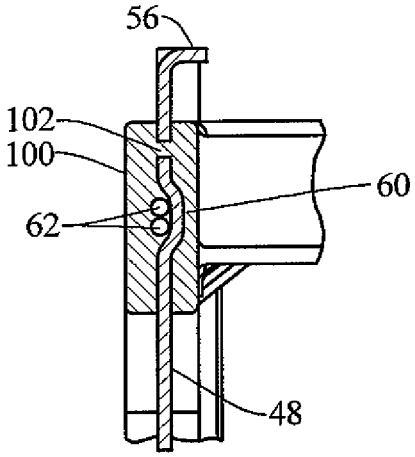
FIG. 16 is a sectional view of the left bracket after assembly taken generally along line XVI-XVI of FIG. 15.
Figure 17:
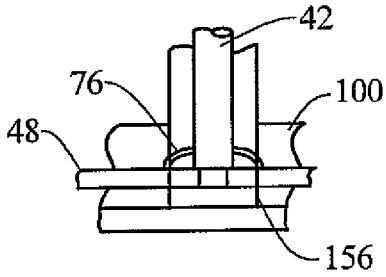
FIG. 17 is a partial top elevational view of a front end of the left bracket and assembled rod, taken generally along the line XVII-XVII of FIG. 15.
Figure 18:
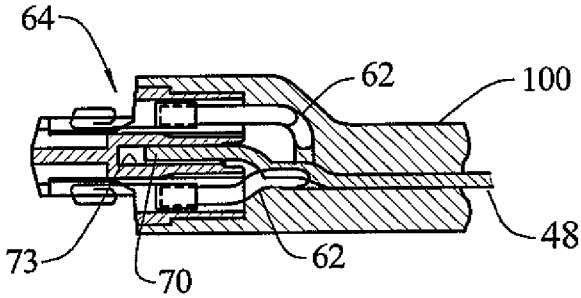
FIG. 18 is a a is a top sectional view of the left bracket, after assembly with the electrical connector and molding process, taken generally along line XVIII-XVIII of FIG. 15.
Figure 19:
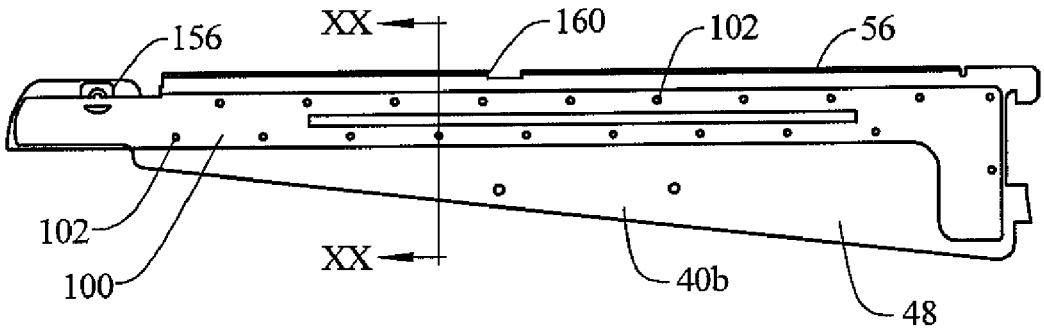
FIG. 19 is a right side elevational view of the frame after assembly and a plastic molding operation.
Figure 20:
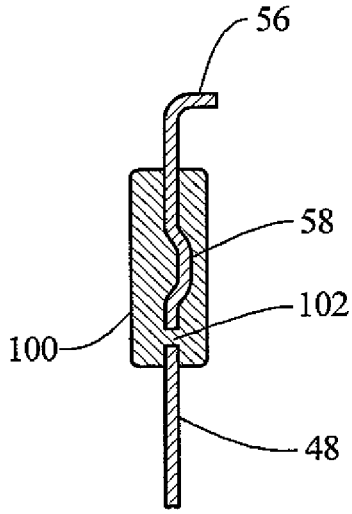
FIG. 20 is a sectional view of the right bracket after assembly taken generally along line XX-XX of FIG. 19.

In an embodiment of the invention, the right bracket 40*b*, the left bracket 40*a* with the attached pod 86 and the two rods 42 may be placed in a mold, with the rods positioned on the ledges 76, 78. The mold is closed and plastic material 100 is injected to overmold at least a portion of the brackets 40 and the rods 42, thus locking the rods in position relative to the brackets and overmolding the pod 86 onto the left bracket 40*a*, as shown in FIG. 3. As illustrated in FIGS. 15-20, the plastic 100 is molded over the brackets 40, from front to rear, at least in the area of the channel 60 so that the wires 62 in the channel are held securely in place. The plastic 100 substantially surrounds the rods 42 (FIG. 17), although there may be portions of the rods left uncovered by plastic where the rods are supported in the mold. The manually accessible buttons 88 on the pod 86 are not overmolded, but remain accessible to the user (FIG. 15).

The bodies 48 of the brackets 40 may be provided with a series of holes 102 in the area overmolded with plastic 100 to allow the plastic to flow evenly over and around the bracket bodies, and to securely lock the plastic to the brackets. The plastic 100 forms a front edge 104 for the frame 38 including a central recess area 106. The plastic 100 also forms a rear edge 108 (FIG. 8) for the frame 38. In the embodiment illustrated, the plastic 100 extends in a continuous manner along substantially the entire length and width of the frame 38 and on both the inside and outside of the bracket bodies 48, yet does not extend the full height of the brackets. In other embodiments, the extent of the plastic 100 may be interrupted in one or more locations along the length and width of the frame 38, and may extend the entire height of the brackets 40.

Figure 21:
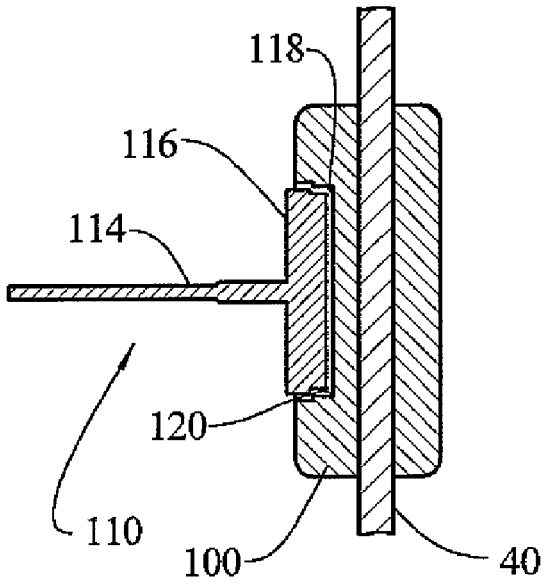
FIG. 21 is a side sectional view of the left side seal element, taken generally along the line XXI-XXI of FIG. 3.
Figure 22:
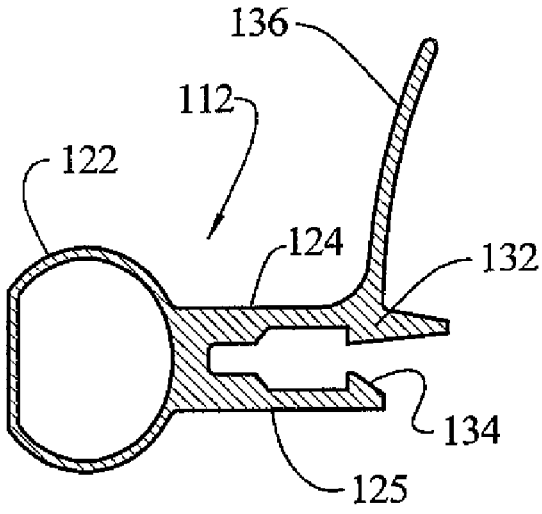
FIG. 22 is a side sectional view of the rear seal element, in isolation and taken generally along the line XXII-XXII of FIG. 3.

As shown in FIG. 3, seal elements 110, 112 may be provided in an embodiment of the invention which extend outwardly along at least portions of the rear 108 and two sides of the frame 38. Although not shown in the drawings, a seal element may also extend along at least a portion of the front 28 of the shelf arrangement 20 and may be secured to mating components, such as door bins, shelving or the door liner, in order to further improve the containment of air. As seen in detail in FIG. 21, the side seal elements 110 are shown to be essentially a thin flexible and resilient flange 114 extending substantially perpendicularly outwardly of a base strip 116. The base strip 116 may be adhered to the bracket 40, such as with a double sided tape or other adhesive material 118, or may be attached mechanically, such as with a mechanical fastening clip. In an embodiment, the base strip 116 may be received in a recessed area 120 of the plastic 100 which will assure the correct placement of the strip. The rear seal element 112 is shown in detail in FIG. 22 in the form of a D-gasket, that is, a generally rounded and enclosed seal element 122 is used instead of the flange construction shown for the side seal elements 110. Either type of seal construction could be used in either location, and other types of seal constructions could also be used.

Figure 23:
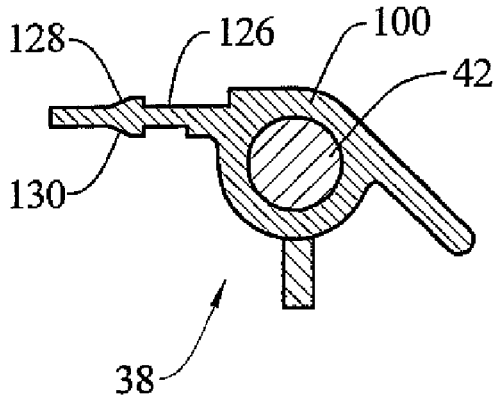
FIG. 23 is a side sectional view of the rear flange and cross rod, prior to attachment of the real seal element, taken generally along the line XXIII-XXIII of FIG. 3.

The rear seal element 112 may be attached to the frame 38 by means of a pair of resilient flanges 124, 125 being captured on a rearwardly facing flange 126 (FIG. 23) of the frame. The rearwardly facing flange 126 is formed of plastic 100 during the molding process, and includes an upper 128 and lower 130 bead or step along its length. These beads or steps 128, 130 serve to capture and hold inwardly facing detents 132, 134 formed along the length of the resilient flanges 124, 125, allowing the flanges to snap onto the rearwardly facing flange 126 and be securely held in place, without the need for additional fasteners or adhesive materials.

The rear seal element 112 also includes an upwardly projecting flange 136 which serves to provide a seal with the shelf member 22 when it is provided in a slidable configuration relative to the frame 38.

Figure 24:
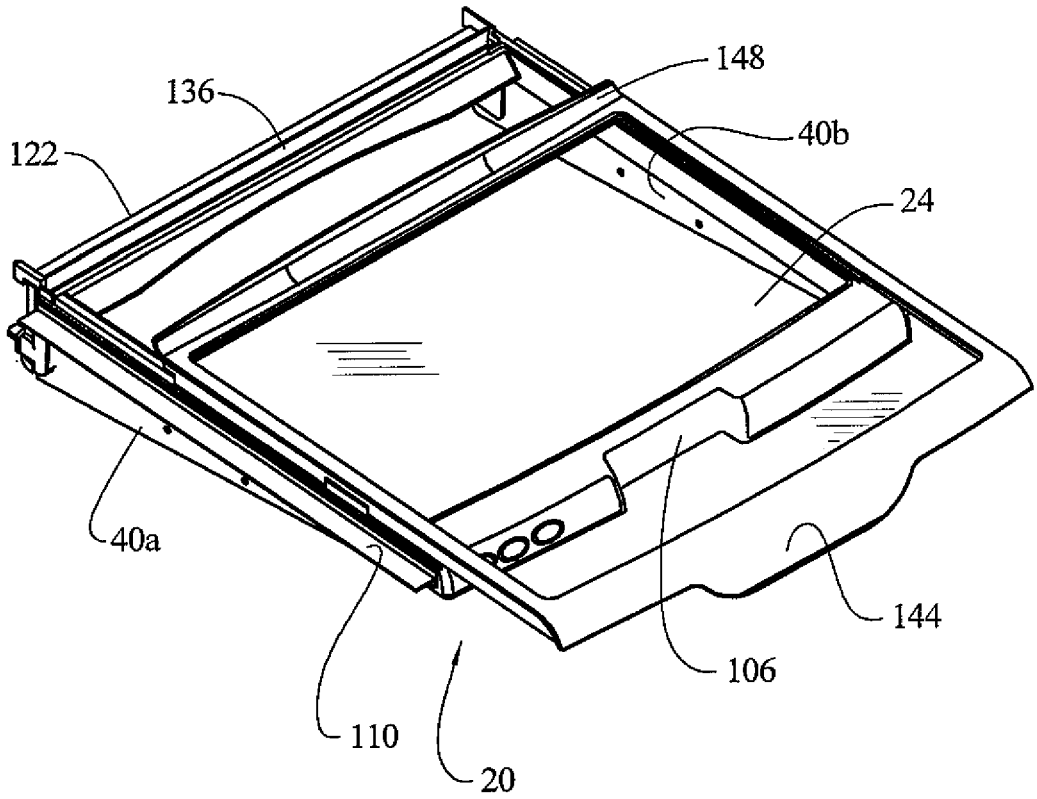
FIG. 24 is a top perspective view of the shelf arrangement embodying the present invention with the shelf member in a partially open position.
Figure 25:
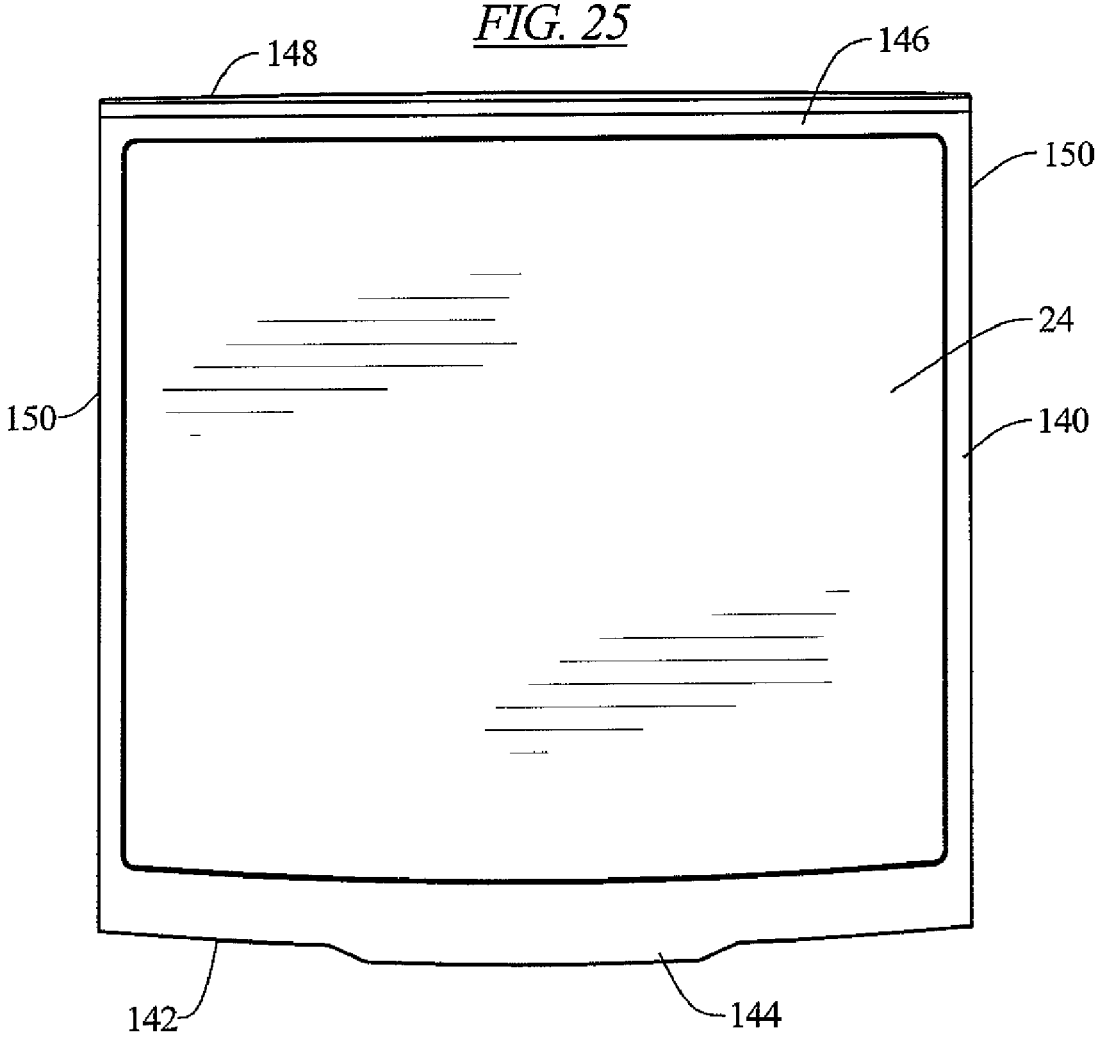
FIG. 25 is a plan view of the shelf member in isolation.
Figure 26:
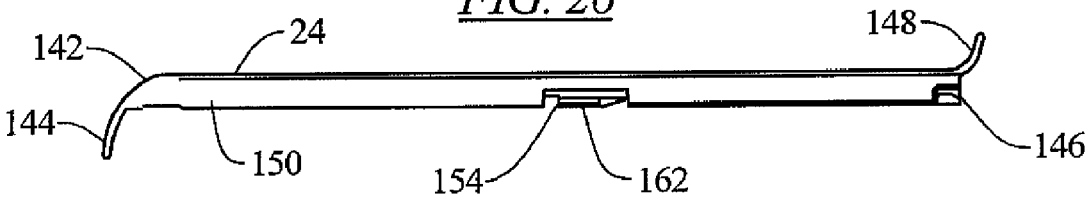
FIG. 26 is a right side elevational view of the self member in isolation.
Figure 27:
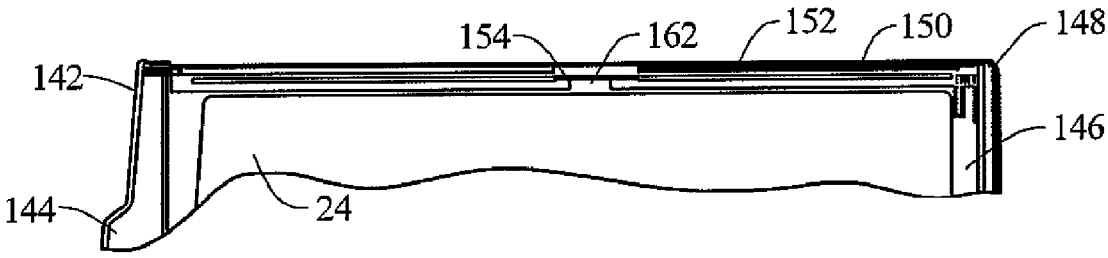
FIG. 27 is a partial bottom elevational view of the right side of the shelf member of FIG. 25.
Figure 28:
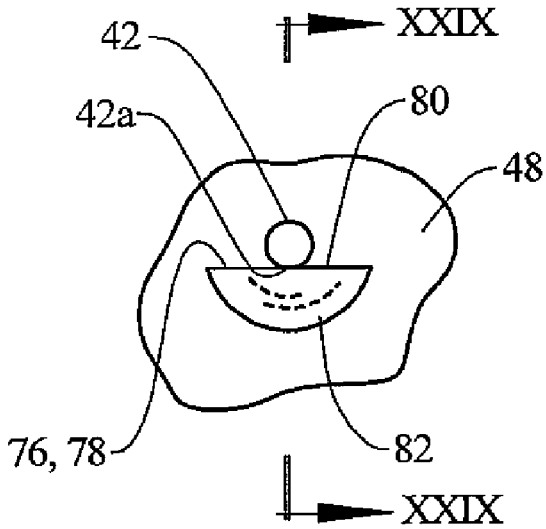
FIG. 28 is a partial side view of the bracket and supported rod taken 90 degrees from the showing of FIG. 17 and without the plastic overmolding.
Figure 29:
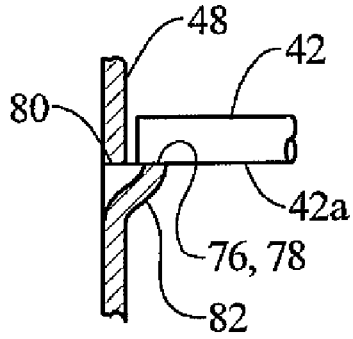
FIG. 29 is a sectional view taken generally along the line XXIX-XXIX of FIG. 28.

The shelf member 22 is shown in isolated detail in FIGS. 25-27 and the support surface 24 may be fabricated of a glass material, or a high strength plastic material, and typically is transparent, although it may also be translucent or opaque. The shelf member 22, in the embodiment illustrated, may be slidable relative to the frame 38 (FIG. 24), and therefore is provided with a plastic molded border 140, surrounding and encapsulating the glass or plastic surface member 24, to provide structural features to assist in the sliding function of the shelf member.

A front edge 142 of the molded border 140 includes a downwardly extending lip 144 which provides a manual grasping surface to allow a user to easily grasp the shelf member 22 to slide it relative to the frame 38. The lip 144 is received in the recess 106 of the molded frame 38, which provides access for a user's fingers when the shelf member 22 is slid into a recessed position relative to the frame.

A rear edge 146 of the molded border 140 includes an upwardly directed flange 148 which mates with the upwardly projecting flange 136 of the rear seal element 112 on the frame 38, to effectively seal the rear edge of the shelf member 22 to the frame.

The side edges 150 of the molded border 140 include a horizontal guide track 152 which rests upon and is supported by the inwardly turned flange 56 of the brackets 40. Thus the shelf member 22 rides on the inwardly turned flanges 56 by means of this guide track 152. A pair of downwardly extending stops 154 are formed on side edges 150 of the molded border 140 to engage with steps 156 (FIGS. 15, 17, 19) formed in the plastic molded frame 38, generally in the area of the front cross rod 42, to prevent the shelf member 22 from being slid forwardly beyond a predetermined extended position. Thus, a user will not be able to accidentally pull the shelf member 22 forwardly to the point of disconnection of the shelf member relative to the frame 38. Typically, this stop position is about one half of the front to rear length of the shelf member 22.

The inwardly turned flanges 56 and the molded border 140 of the shelf member 22 include cutouts 160 and fingers 162 to permit the shelf member to be tilted upwardly relative to the frame 38, so that the shelf member can be disengaged from and reengaged with the frame for complete removal and replacement purposes.

When the frame 38 is mounted within the refrigeration appliance 30, the top tabs 44 are received in the ladder supports 50 and the bottom tab 46 on the right bracket 40*b* is also received in the ladder support. The electrical connector 60 on the left bracket 40*a* is received in an opening in the ladder support 50 where it will engage with an electrical conductor positioned within the ladder support area, such as described in U.S. Pat. No. 6,813,896 incorporated herein by reference.

The side seal elements 110 will engage with interior side walls 170 of the refrigeration appliance cabinet 32 and the rear seal element 112 will engage with the rear wall 51 of the refrigeration appliance cabinet, so that the shelf arrangement 20 will effectively seal off an area within the refrigeration appliance cabinet to prevent a flow of air from an area above the shelf arrangement to an area below the shelf, and vice versa. In this manner, the shelf arrangement 20 will completely isolate an area within the refrigeration cabinet 32, which will permit the atmosphere in the isolated area to be altered with respect to temperature, humidity, light or other characteristics.

The various features of the shelf arrangement 20 illustrated and discussed above may be used separately or in various combinations, beyond the single combination shown and described. For example, the wire channel 60 may be utilized without overmolding of the frame, overmolding of the frame may be utilized without cross rods in the frame, cross rods may be used in the frame without overmolding of the frame, and other combinations and permutations of the various features may be incorporated in a shelf arrangement, while still utilizing the invention disclosed and claimed herein.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A shelf arrangement comprising:

a shelf member including a support surface, a frame comprising a pair of laterally spaced apart front-to-rear brackets supporting said shelf member and a pair of rods extending laterally between said brackets, said rods having a lower surface area, said brackets each having a ledge near a front end and a rear end of the bracket for supporting an end of said rods, said ledges comprising a top surface formed of a lower edge of a generally horizontal slit formed in said brackets near a front end and a rear end of said brackets with a portion of the bracket below the slit being displaced out of a plane of a surrounding portion of said brackets, a vertical engagement between said rods and said brackets being limited to said lower surface area of said rods engaging and being supported by said top surface of said ledge, and an electrical control interface positioned and accessible at a front of said shelf arrangement, said control interface arranged to transmit a control signal to a location remote from said shelf arrangement.

2. A shelf arrangement according to claim 1, wherein said frame is at least partially overmolded with plastic.

3. A shelf arrangement according to claim 2, Wherein said pair of rods are surrounded and held in place between said brackets by said plastic.

4. A shelf arrangement according to claim 1, wherein said frame is at least partially overmolded with plastic and seal elements extend outwardly along at least portions of a rear and two sides of said frame.

5. A shelf arrangement according to claim 1, wherein seal elements extend outwardly along at least portions of a rear and two sides of said frame.

6. A shelf arrangement according to claim 1, wherein said shelf member is horizontally movable relative to said frame.

7. A shelf arrangement comprising:

a support surface, a frame comprising a pair of laterally spaced apart front-to-rear brackets supporting said support surface, an electrical control interface positioned and accessible at a front of said shelf arrangement at a fixed position relative to said frame, a pair of electrical conductors connected to said electrical control interface, and an electrical connector positioned at a rear of said frame and being connected to said electrical conductors, and a front-to-rear channel formed in one of said brackets, said channel being recessed into one side of said bracket to form an interior of said channel and extending beyond a surface on an opposite side of said bracket, said channel forming a continuous communication path from said control interface to said electrical connector for said electrical conductors, said electrical conductors being received in said interior of said channel of said one bracket to extend along a front-to-rear length of said bracket, said frame being at least partially overmolded with plastic, said overmolding being provided at least in the area of said interior of said channel in said one bracket to overcoating said electrical conductors and filling said channel.

8. A shelf arrangement according to claim 7, wherein said frame includes flow holes therethrough at least in an area of said channel to allow passage of plastic during overmolding of said frame.

9. A shelf arrangement according to claim 7, wherein said frame comprises a pair of rods extending laterally between said brackets.

10. A shelf arrangement according to claim 7, including seal elements extending outwardly along at least portions of a rear and two sides of said frame.

11. A shelf arrangement according to claim 7, wherein said support surface is horizontally movable relative to said frame.

12. An appliance comprising:

a cabinet with an interior space, and a shelf arrangement supported in said interior space and comprising:

a support surface, a frame comprising a pair of laterally spaced apart front-to-rear brackets supporting said support surface, an electrical control interface positioned and accessible at a front of said shelf arrangement at a fixed position relative to said frame, a pair of electrical conductors connected to said electrical control interface, and an electrical connector positioned at a rear of said frame and being connected to said electrical conductors, and a front-to-rear channel formed in one of said brackets, said channel being recessed into one side of said bracket to form an interior of said channel and extending beyond a surface on an opposite side of said bracket, said channel forming a continuous communication path from said control interface to said electrical connector for said electrical conductors, said electrical conductors being received in said interior of said channel of said one bracket to extend along a front-to-rear length of said bracket, said frame being at least partially overmolded with plastic, said overmolding being provided at least in the area of said interior of said channel in said one bracket overcoating said electrical conductors and filling said channel.

13. An appliance according to claim 12, including a pair of rods extending laterally between said brackets.

14. A shelf arrangement according to claim 7, wherein said electrical control interface comprises a preassembled pod which includes a channel to receive a forward end of said one bracket, said one bracket forward end including detents for lockingly engaging into said pod channel.

15. A shelf arrangement according to claim 14, wherein said overmolding is provided in the area of said engagement of said bracket into said pod.

16. A shelf arrangement according to claim 7, wherein said one bracket has a rearwardly extending finger at said rear end and said electrical connector includes a slot for receiving said finger.

17. A shelf arrangement according to claim 16, wherein said overmolding is provided in the area of said electrical connector and bracket finger.

18. A shelf arrangement according to claim 10, wherein said overmolding is provided along a front-to-back length of both brackets and a recessed area is provided in said overmolding for receiving said seal elements for said two sides of said frame.

19. An appliance comprising:

a cabinet with an interior space, and a shelf arrangement supported in said interior space and comprising:

a shelf member including a support surface, a frame comprising a pair of laterally spaced apart front-to-rear brackets supporting said shelf member and a pair of rods extending laterally between said brackets, said rods having a lower surface area, said brackets each having a ledge near a front end and a rear end of the bracket for supporting an end of said rods, said ledges comprising a top surface formed of a lower edge of a generally horizontal slit formed in said brackets near a front end and a rear end of said brackets with a portion of the bracket below the slit being displaced out of a plane of a surrounding portion of said brackets, a vertical engagement between said rods and said brackets being limited to the lower surface area of said rods engaging and being supported by said top surface of said ledge, and an electrical control interface positioned and accessible at a front of said shelf arrangement, said control interface arranged to transmit a control signal to a location remote from said shelf arrangement.

* * * * *